US005924288A

United States Patent [19]

Fortuna et al.

[11] Patent Number: 5,924,288

[45] Date of Patent: Jul. 20, 1999

[54] ONE-PIECE COMBUSTOR COWL

[75] Inventors: Douglas M. Fortuna, Cincinnati; Phillip D. Napoli, West Chester; Richard A. Duke, Cincinnati, all of Ohio

[73] Assignee: General Electric Company, Cincinnati, Ohio

[21] Appl. No.: 08/811,754

[22] Filed: Mar. 6, 1997

Related U.S. Application Data

[63] Continuation of application No. 08/362,044, Dec. 22, 1994, abandoned.

[51] Int. Cl.[6] ..... F02C 1/00

[52] U.S. Cl. ..... 60/752

[58] Field of Search ..... 60/39.36, 752, 60/755, 756

[56] References Cited

U.S. PATENT DOCUMENTS

| | | | |
|---|---|---|---|
| 3,775,975 | 12/1973 | Stenger et al. | 60/39.32 |
| 3,842,595 | 10/1974 | Smith et al. | 60/39.36 |
| 3,854,285 | 12/1974 | Stenger et al. . | |
| 3,990,232 | 11/1976 | Campbell . | |
| 4,050,241 | 9/1977 | DuBell . | |
| 4,194,358 | 3/1980 | Stenger | 60/39.06 |
| 4,555,901 | 12/1985 | Wakeman et al. | 60/39.32 |
| 4,614,082 | 9/1986 | Sterman et al. | 60/39.32 |
| 4,686,823 | 8/1987 | Coburn et al. | 60/752 |
| 4,870,818 | 10/1989 | Suliga | 60/756 |
| 4,934,145 | 6/1990 | Zeisser | 60/756 |
| 5,181,377 | 1/1993 | Napoli et al. | 60/39.31 |
| 5,239,832 | 8/1993 | Koshoffer et al. | 60/740 |

*Primary Examiner*—Michael Koczo
*Attorney, Agent, or Firm*—Andrew C. Hess; David L. Narciso

[57] ABSTRACT

A one-piece cowl is provided for use in assembled relationship with a combustor of a gas turbine engine. The cowl is of a generally annular configuration which defines a central cowl axis, and is axially elongated and aerodynamically contoured relative to the central cowl axis. In order to provide a vibratory damping function for the cowl, a solid lip of increased thickness is formed at a leading edge of the cowl.

11 Claims, 3 Drawing Sheets

ONE-PIECE COMBUSTOR COWL

This application is a Continuation of application Ser. No. 08/362,044 filed Dec. 22, 1994 abandoned.

BACKGROUND OF THE INVENTION

1. Field of the Invention

The present invention relates generally to gas turbine engines and, more particularly, to an improved cowl structure for use in the combustion chamber of a gas turbine engine.

2. Description of Related Art

In a gas turbine engine, pressurized air is provided from the compressor stage to the combustor, whereupon it is mixed with fuel and is burned in the combustion chamber. The amount of pressurized air which enters the fuel/air mixes, and correspondingly the inner and outer passages of the combustor, has typically been regulated by inner and outer cowls located upstream of the fuel/air mixers and the combustor dome. Such cowls have been generally held in place by means of a bolted joint which includes the combustor dome, the cowl, and either the inner outer combustor liner. Accordingly, both the outer and inner cowls of a gas turbine engine experience a slight change in pressure thereacross, as well as a vibratory load induced by the engine. While these environmental factors have a greater effect on the outer cowl, they nevertheless cause wear on both cowls which consequently limit the life thereof.

In addressing this problem, the prior art has generally taken one of two approaches. The first of which involves use of a sheet metal body for the cowls with a lip formed at the leading edge thereof, preferably by curling or wrapping the sheet metal around a damper wire. However, it has been found that this design is life-limited due to a rubbing-type wear occurring at the interface of the wire and the sheet metal body. One attempt to circumvent this rubbing wear problem is disclosed in U.S. Pat. No. 5,181,377 to Napoli et al., where a two-ply, laminate configuration is described. Besides having to maintain the structural integrity of this two-ply configuration, however, another concern with the lip disclosed therein is the structural integrity for vibration damping under a variety of operating conditions.

Still another cowl design involves a machined ring which forms the leading edge lip of the cowl, where the ring is welded to a formed sheet metal body. Such a machined ring provides a solid lip for the cowl, which is desirable, but circumferential welding thereof to the formed sheet metal body has resulted in stress concentrations both in and around the weld which are sources of failure initiation of the cowl.

Accordingly, it would be desirable for a cowl structure to be developed for the combustor of a gas turbine engine which provides not only a solid lip at the leading edge thereof, but also has the structural integrity to significantly increase the life of the cowl. Moreover, it would be advantageous for such a cowl to eliminate all rubbing wear while performing its vibratory damping function.

SUMMARY OF THE INVENTION

In accordance with the present invention, a one-piece cowl is provided for use in assembled relationship with a combustor of a gas turbine engine. The one-piece cowl is of a generally annular configuration which defines a central cowl axis, and is axially elongated and aerodynamically contoured relative to the central cowl axis. In order to provide a vibratory damping function for the one-piece cowl, a solid lip of increased thickness is formed at a leading edge of the cowl.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
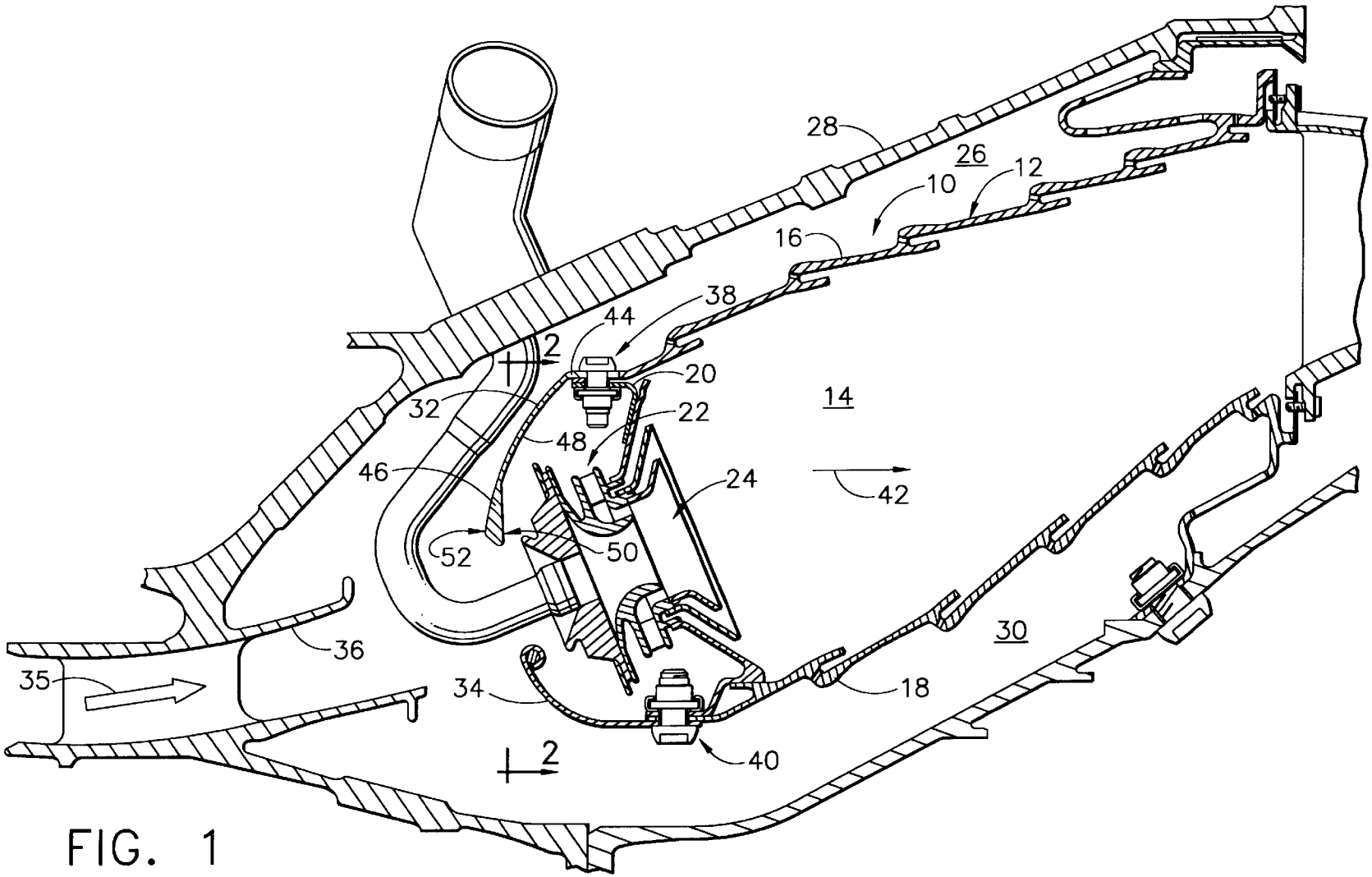
FIG. 1 is a longitudinal sectional view through a combustor structure of a gas turbine engine having an outer cowl in accordance with the present invention.

Referring now to the drawings in detail, wherein identical numerals indicate the same elements throughout the figures, FIG. 1 depicts a continuousburning combustion apparatus 10 of the type suitable for use in a gas turbine engine and comprising a hollow body 12 defining a combustion chamber 14 therein. Hollow body 12 is generally annular in form and is comprised of an outer liner 16, an inner liner 18, and a domed end or dome 20. In the present annular configuration, the domed end 20 of hollow body 12 includes a swirl cup 22, having disposed therein a mixer 24 of known design.

As seen in FIG. 1, an outer passage 26 is formed between outer liner 16 and a casing 28 of gas turbine engine 10. Likewise, an inner passage 30 is formed between inner liner 18 and casing 28. An outer cowl 32 and an inner cowl 34 are provided upstream of and radially outward and inward, respectively, of mixer 24 in order to properly direct and regulate the flow of pressurized air from a diffuser 36 to dome 20 and outer and inner passages 26 and 30. Outer cowl 32 is connected at a downstream end to outer liner 16 and dome 20 by means of a bolted joint 38. Inner cowl 34 is similarly connected to inner liner 18 and dome 20 by means of a bolted joint 40.

Figure 2:
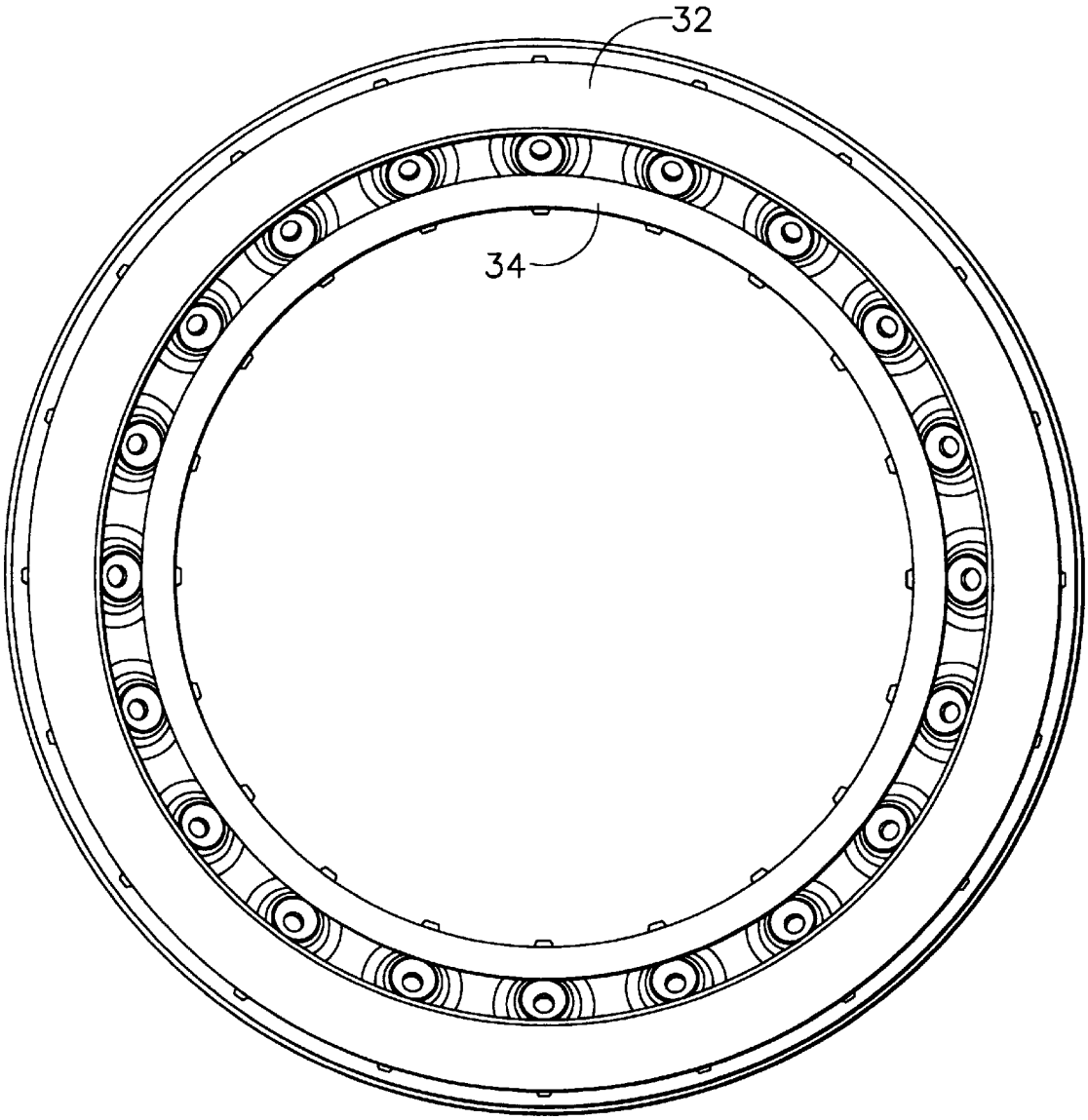
FIG. 2 is a partial front view of the combustor depicted in FIG. 1.
Figure 3:
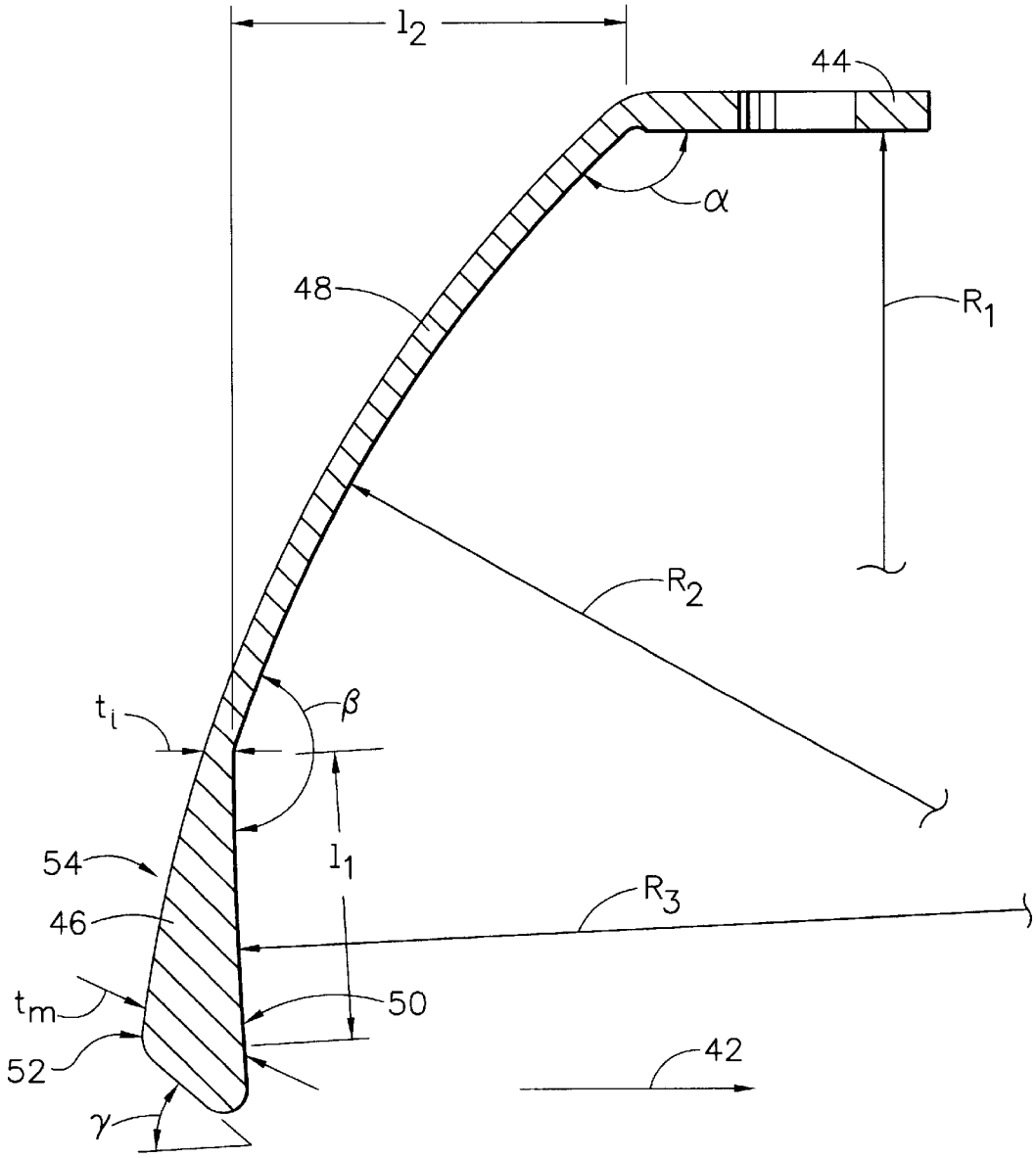
FIG. 3 is a an enlarged, cross-sectional view of the outer cowl depicted in FIG. 1.

It will be seen from FIGS. 1 and 2 that outer and inner cowls 32 and 34 are generally annular in configuration and define a central cowl axis 42. Moreover, outer and inner cowls 32 and 34 are axially elongated and aerodynamically contoured relative to central cowl axis 42. As best seen in FIG. 3, outer cowl 32 has an aft section 44, a fore section 46, and a middle section 48 located between aft and fore sections 44 and 46. It will be understood that aft section 44, which is that part of outer cowl 32 affixed to outer liner 16 and dome 20 in bolted joint 38, is slightly arcuate and has a radius $R_1$. Likewise, fore section 46 of outer cowl 32 is also slightly accuate in shape and has a radius $R_3$. Middle section 48 of outer cowl 32 is substantially arcuate in shape and a radius $R_2$. Preferably, radius $R_1$ of aft section 44 is greater than radius $R_2$ of middle section 48 and radius $R_2$ of middle section 48 is less than radius $R_3$ of fore section 46.

As best seen in FIG. 3, aft section 44 of outer cowl 32, because of its radius $R_1$, appears substantially linear. Aft section 44 is preferably oriented substantially parallel to central cowl axis 42. Due to the difference in the size of their respective radii $R_1$ and $R_3$, middle section 48 is oriented at an angle $\alpha$ to aft section 44, where angle $\alpha$ preferably is within a range of 125 to 150°.

It will also be seen in FIG. 3 that fore section 46 of outer cowl 32 is preferably oriented substantially perpendicular to central cowl axis 42. Because radii $R_2$ and $R_3$ of fore section 46 and middle section 48 are different, an angle β is defined between fore and middle sections 46 and 48 which preferably falls within a range of 145° to 155°.

Further, it is preferred that fore section 46 increase in thickness from an initial thickness $t_i$ adjacent middle section 48 to a maximum thickness $t_m$. By so doing, a solid lip 50 is formed at a leading edge 52 of outer cowl 32. This gradual increase in thickness of fore section 46 is known herein as a transition zone 54 which has a specified length $l_1$. In order to provide the damping function for outer cowl 32, solid lip 50 defined within fore section 46 is substantially teardrop-shaped. As such, maximum thickness $t_m$ of fore section 46 is preferably 4 to 5 times greater than initial thickness $t_i$ thereof. Additionally, leading edge 52 is oriented at an angle to γ to axis 42 in a preferred range of 40 to 50°.

It will be understood that length $l_1$ of transition zone 54 is dependent upon several factors, including angle β between fore and middle sections 46 and 48, the axial length $l_2$ of middle section 38 (see FIG. 3), and the ratio between maximum thickness $t_m$ and initial thickness $t_i$ of fore section 46. More specifically, length $l_1$ is less when angle β is lower (i,e., more toward 90°) and greater when angle β is greater (i.e., more toward 180°). Likewise, length $l_1$ will be less when the axial length $l_2$ is less and more when the axial length is more. Length $l_1$ is further related to the ratio between the maximum thickness $t_m$ and the initial thickness $t_i$ of fore section 46, where length $l_1$ is less when the ratio is lower and length $l_1$, is more when the ratio is greater. In each case, the effect on length $l_1$ is related to the need for a greater or lesser transitional zone 54 to enable the transition to be more or less gradual because of the stresses imposed thereon. By accounting for these factors, solid lip 50 is properly formed on fore section 46 so as to provide the desired structural integrity.

Until recently, a one-piece combustor cowl having an increased thickness at the leading edge thereof has not been feasible. However, due to the availability of advanced materials (e.g., Inco 718) and rolling methods, such one-piece cowl structures are now possible. By having a one-piece design, the combustor cowl of the present invention is able to minimize manufacturing defects and stress concentrations, as well as eliminate rubbing wear found with previous designs.

In particular, a preferred process for forming the cowl of the present invention is to begin with a rectangular bar of steel which is rolled into a ring having a generally standard thickness with a teardrop-shaped mass of increased thickness at the leading edge thereof so as to form a near net shape. Thereafter, a solid teardrop lip is produced at the leading edge by any of a variety of manufacturing techniques, such as machining, rolling, spinning, etc.

Having shown and described the preferred embodiment of the present invention, further adaptations of the one-piece combustor cowl regulating air flow in a combustor can be accomplished by appropriate modifications by one of ordinary skill in the art without departing from the scope of the invention. In particular, while the combustor cowl of the present invention has been described with respect to outer cowl 32, a similar one-piece design may be utilized for inner cowl 34 which would be a substantially mirror image of outer cowl 32.

What is claimed is:

1. A one-piece, integrally formed cowl for use in assembled relationship with a combustor of a gas turbine engine, said cowl being of a generally annular configuration defining a central cowl axis and being axially elongated and aerodynamically contoured relative to said central cowl axis, wherein said cowl is located radially adjacent to only one side of a plurality of circumferentially spaced mixers of said combustor, said cowl comprising:

(a) an aft section connected to a liner of said combustor;

(b) a middle section located upstream of said aft section; and (c) a fore section located upstream of said middle section and being oriented substantially perpendicular to said central cowl axis, said fore section increasing in thickness from an initial thickness adjacent said middle section to a maximum thickness in order to form a solid lip at a leading edge of said cowl.

2. The one-piece cowl of claim 1, said aft section being oriented substantially parallel to said central cowl axis.

3. The one-piece cowl of claim 1, said middle section being substantially arcuate.

4. The one-piece cowl of cliam 1, wherein said cowl is located radially to the outside of side spaceed mixers.

5. The one-piece cowl of claim 1, wherein said middle section is oriented at an angle to said aft section in a range of 125 to 150°.

6. The one-piece cowl of claim 1, wherein said middle section is oriented at an angle to said fore section in a range of 145° to 155°.

7. The one-piece cowl of claim 1, wherein said solid lip is substantially teardrop-shaped.

8. The one-piece cowl of claim 1, wherein said maximum thickness of said fore section is greater than said middle section thickness by 4 to 5 times.

9. The one-piece cowl of claim 1, wherein said fore section and said middle section are substantially arcuate and said fore section has a radius less than a radius of said middle section.

10. A one-piece, integrally formed cowl for use in assembled relationship with a combustor of a gas turbine engine, said cowl being of a generally annular configuration defining a central cowl axis and being axially elongated and aerodynamically contoured relative to said central cowl axis, wherein said cowl is located radially adjacent to only one side of a plurality of circumferentially spaced mixers of said combustor, said cowl comprising:

(a) an aft section connected to a liner of said combustor;

(b) a middle section located upstream of said aft section; and (c a fore section located upstream of said middle section, said fore section increasing in thickness form an initial thickness adjacent said middle section to a maximum thickness in order to form a solid lip at a leading edge of said cowl;

wherein said leading edge of said cowl is a surface whose plane intersects said central cowl axis at an angle in a range of 40 to 50°.

11. A one-piece, integrally formed cowl for use in assembled relationship with a combustor of a gas turbine engine, said cowl being of a generally annular configuration defining a central cowl axis and being axially elongated and aerodynamically contoured relative to said central cowl axis, wherein said cowl is located radially adjacent to only one side of a plurality of circumferentially spaced mixers of said combustor, said cowl comprising:

(a) an aft section connected to a liner of said combustor;

(b) a middle section located upstream of said aft section, wherein said middle section and said aft section are substantially arcuate and said middle section has a radius less than a radius of said aft section; and (c) a fore section located upstream of said middle section, said fore section increasing in thickness from an initial thickness adjacent said middle section to a maximum thickness in order to form a solid lip at a leading edge of said cowl.

* * * * *